United States Patent [19]

Chriswell et al.

[11] Patent Number: 5,024,753

[45] Date of Patent: Jun. 18, 1991

[54] MATERIAL SEPARATION EFFICIENCY DETERMINATION EMPLOYING FLUORESCING CONTROL PARTICLES

[75] Inventors: Colin D. Chriswell, Slater; Richard Markuszewski, Ames; William H. Buttermore, Ames, all of Iowa

[73] Assignee: Iowa State University Research Foundation, Inc., Ames, Iowa

[21] Appl. No.: 416,710

[22] Filed: Oct. 3, 1989

[51] Int. Cl.[5] ..... B03B 13/02

[52] U.S. Cl. ..... 209/1; 209/546

[58] Field of Search ..... 209/1, 546, 931, 3.1-3.3; 250/302, 303; 252/60, 408.1, 965; 364/502

[56] References Cited

U.S. PATENT DOCUMENTS

| | | | |
|---|---|---|---|
| 1,678,884 | 7/1928 | Sweet | 209/3.1 |
| 3,346,111 | 10/1967 | Thompson et al. | 209/3.3 |
| 3,356,211 | 12/1967 | Mathews | 209/3.1 |
| 3,472,375 | 10/1969 | Mathews | 209/3.1 X |
| 3,736,500 | 5/1973 | Berkowitz et al. | 324/203 |
| 3,795,310 | 3/1974 | Buchot et al. | 209/3.3 X |
| 3,992,287 | 11/1976 | Rhys | 209/3.1 |
| 4,152,271 | 5/1979 | Eisenberg | 252/965 X |
| 4,197,104 | 4/1980 | Krystyniak et al. | 250/302 X |
| 4,208,273 | 6/1980 | Moudgil et al. | 209/3.3 |
| 4,345,994 | 8/1982 | Leonard, III et al. | 209/1 |
| 4,347,125 | 8/1982 | Di Giacomo | 209/3.3 |
| 4,462,495 | 7/1984 | McKinley et al. | 209/3.3 X |
| 4,702,379 | 10/1987 | Clayton et al. | 209/539 |
| 4,830,193 | 5/1989 | Clayton et al. | 209/3.1 |
| 4,857,172 | 8/1989 | Pipkin et al. | 209/1 |

FOREIGN PATENT DOCUMENTS

| | | | |
|---|---|---|---|
| 2061771 | 5/1981 | United Kingdom | 209/931 |

OTHER PUBLICATIONS

"*Continuous Measurements of Consistency of Ferrosilicon/Magnetite Suspension in a Drum Type Heavy Media Plant*", Laszlo Valentyik, National Sand and Gravel Association (NSGA) Circular No. 106, Apr. 1970.

"*A Magnetic Tracer Technique to Determine Partition Coefficients for Gravity Separators*", Dr. William Foreman et al., Presented at Second Symposium on Coal Preparation, Oct. 1976.

Methods & Machines—Density Tracers Evaluate Gravity Concentration Plant Performance, Mining Journal, Aug. 1983, p. 115.

*Primary Examiner*—Michael S. Huppert
*Assistant Examiner*—Edward M. Wacyra
*Attorney, Agent, or Firm*—Zarley, McKee, Thomte, Voorhees, & Sease

[57] ABSTRACT

An improved material separation system and method utilizing control particles of generally known physical characteristics as tracer particles through the separation process. The control particles are generally the same or similar to the materials being separated and are coated with or bonded to a fluorescing dye. The control particles are mixed with the material to be separated prior to separation. The mixture is imposed with a energy source which excites the fluorescent dye causing fluorescing emission. The fluorescing emission is detected at the output of the separation of the mixture to determine if the separation is operating efficiently and as desired.

36 Claims, 1 Drawing Sheet

MATERIAL SEPARATION EFFICIENCY DETERMINATION EMPLOYING FLUORESCING CONTROL PARTICLES

BACKGROUND OF THE INVENTION a. Field of the Invention

The present invention relates to material separation, and in particular, to an improved means and method of material separation such as coal cleaning or ore separation and processing.

b. Problems in the Art

The process of coal cleaning is a well known art. It is a continual goal to increase the efficiency of coal cleaning, which will in turn result both in better combustible coal and in savings in cost and time for the coal cleaning process. Increased efficiency and better monitoring is a goal of any type of material separation process.

In coal separation processes, the desired size or sorting of coal is selectable. The separation equipment, such as gravity separators, cyclones, shaker tables, etc., need to be adjusted and constantly monitored to make sure that the separation process is achieving the desired output of coal.

If the separation is not correctly proceeding, or if it is not being done efficiently, costs are incurred in utilizing coal that has been improperly cleaned, or in recleaning the coal.

If incorrect separation is detected, adjustments must be made to the separation equipment. An elementary method for monitoring the separation process is to visually examine samples of the cleaning output, and determine if the separation process is proceeding correctly. However, such requires direct and time-consuming manual labor and can result in significant amounts of improperly cleaned coal before adjustments can be made. Analogous problems exist with other types of material separation.

There is therefore a need for improved, less labor-intensive and more contemporaneous monitoring of material separation. Attempts have been made at solving this problem.

One recent approach with respect to coal cleaning has been to prepare synthetic particles of generally uniform size and density. The particles are color-coded or magnetically loaded plastic particles which are mixed into the coal being cleaned.

Because the synthesized particles are of known size and density, their ultimate destination in the separation process is predictable. They are therefore counted or otherwise detected at the output of the separation or cleaning process. By doing so, it can be determined whether the separation apparatus is functioning properly.

While this has represented an improvement in monitoring the efficiency of coal cleaning processes, there is still room for improvement. First of all, the synthetic particles simply do not sufficiently approach the actual characteristics of the coal being separated. There is therefore a considerable margin of error because the synthetic control particles behave significantly differently from actual coal particles in the separation and cleaning process. The synthetic particles cannot sufficiently simulate actual coal particles.

Secondly, the technology regarding the cleaning of coal has advanced to the point where increasingly smaller and smaller coal sizes are required to attain the desired levels of ash and sulfur removal. For example, today some advanced coal cleaning technologies require the density separation of sizes of coal on the order of minus 200 mesh. New cleaning units, such as true heavy-liquid cyclones, are being developed to clean these fine coals.

It is presently impossible to synthesize control particles on this size and density level. Thus, a very real need in the art exists for a method to monitor coal cleaning at this particle size level.

Attempts are being made to solve these problems by selectively tagging fine coal mineral fractions with ultrafine magnetite. While this may be applicable to very small particle sizes of coal, problems still exist with this method. First of all, very costly preparation techniques are needed to produce the control particles tagged with the ultrafine magnetite. Secondly, true chemical bonding of the magnetite particles with the coal particle surface cannot be made. Thus, the magnetite can become displaced as a result of abrasion or solvation in separation equipment, which will degrade the validity of the method. Third, this method cannot be effectively used for dense-media processes which themselves employ magnetite. These methods represent a large proportion of all current physical cleaning processes for coals. Fourth, detection of the particles would have to be by magnetic means. Because of the inherent makeup of coal cleaning processes, there would likely be interference and error because of the presence of residual magnetic media, as well as other complications.

Again, similar or analogous problems and deficiencies exist with respect to other types of material separation processes.

It is therefore a principal object of the present invention to provide a means and method for improved material separation which overcomes or solves the problems and deficiencies in the art.

A further object of the present invention is to provide a means and method as above described which can be utilized for all, or at least most, types of material separation processes, and for all, or at least many, types of materials.

A further object of the present invention is to provide a means and method as above described which can greatly increase the efficiency of material separation processes.

A further object of the present invention is to provide a means and method as above described which introduces control particles to assist in monitoring material separation efficiency, where the control particles react exactly the same to the material separation process as the material itself.

A still further object of the present invention is to provide a means and method a above described which is applicable to material separation of all sizes of material, including down to extremely small particle sizes at or smaller than minus 200 mesh.

Another object of the present invention is to provide a means and method as above described which produces control particles economically and efficiently, and gives results economically and efficiently.

A further object of the present invention is to provide a means and method as above described which is non-complex, readily usable, and presents a low margin of error.

A still further object of the present invention is to provide a means and method as above described which greatly enhances the ability to efficiently monitor material separation efficiency These and other objects, features, and advantages of the present invention will become more apparent with reference to the accompanying specification and claims.

SUMMARY OF THE INVENTION

The present invention relates to a means and method for increasing and improving the efficiency of material separation such as, for example, coal cleaning and ore separation. It is applicable to most sizes, types, and densities of materials for material separation and for different material separation mechanisms.

The method of the invention prepares control particles of material prior to beginning the material separation process, the control particles having generally known and generally consistent physical properties. At least one fluorescent dye is bonded to the control particles. The control particles are then mixed into the material being separated An energy source of such characteristics to fluorescently excite the dye is operated to impose energy upon the mixture of material and control particles. The output of the material separation process is then monitored by a fluorescence detector or detectors.

The detector or detectors recognize and signal the intensity of emitted fluorescence from the control particles, which have been exposed to the energy.

By monitoring the intensity of fluorescence received by the detector or detectors, it can be determined whether the material separation is operating as desired. That is, it can be determined if material particles of certain characteristics are being separated appropriately.

The apparatus of the invention utilizes appropriate ponents to achieve the method. The advantages of the invention are that monitoring of material separation processes for material particles of all sizes of materials, including very small sizes can take place, since the control particles can be economically and efficiently made even at sub-micron-size. Moreover, the invention is advantageous because the control particles are themselves the same or similar to the particles being separated, and therefore react exactly like the material being separated with respect to the material separation process. The fluorescing dyes do not interfere with or alter the separation characteristics of the control particles or limit the size of the control particles.

DETAILED DESCRIPTION OF A PREFERRED EMBODIMENT OF THE INVENTION

Figure 1:
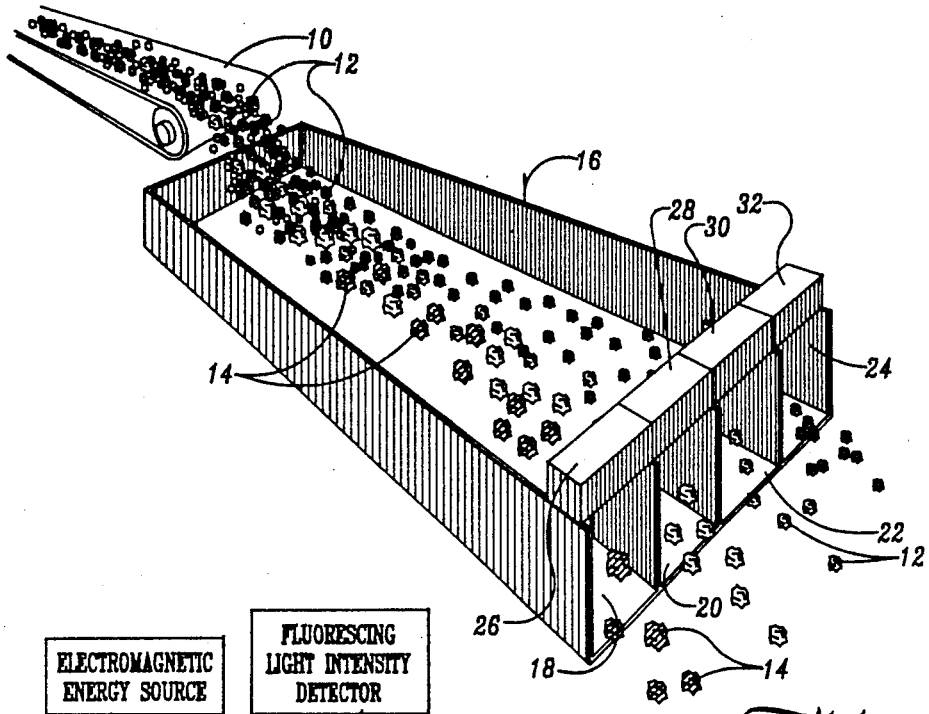
FIG. 1 is a perspective view of a simplified material separation apparatus according to the present invention.

With reference to the drawings, a preferred embodiment of the present invention will no be described. It is to be understood that reference numerals will be utilized to indicate features shown in the drawings. The preferred embodiment will be primarily described in the context of the separation of coal particles in the process of coal cleaning. However, it is to be understood the invention applies analogously to other separation processes for other materials, and is not limited to coal cleaning.

With particular reference to FIG. 1, a general description of the invention will be given. A conveyer 10 carries a mixture of crushed coal particles (referred to by reference numeral 12); and a plurality of control particles (referred to by reference numeral 14, and distinguished from particles 12 by cross-hatching).

The control particles 14 are previously prepared. All control particles have a generally known size and/or density range, and therefore their passage through the coal cleaning separation process is highly predictable. Additionally, control particles 14 have a fluorescent dye bonded or attached thereto. Generally, in the preferred embodiment, the control particles can be mixed by measured quantities into the material being separated.

The coal particles 12, on the other hand, have been preprocessed to the point of being prepared for the coal cleaning process, such as is well-known in the art.

Separator-cleaning means 16 is shown in FIG. 1 receiving the mixture of coal particles 12 and control particles 14, and by means known in the art, separates the particles by ranges of density to specific outlets 18, 20, 22 or 24. Alternatively, separation could be controlled by a different material property such as, for example, weight or size. Particles of a desired characteristic or material property can then be selected from the appropriate outlet and utilized. It is to be understood that mechanical separation of coal particles can be accomplished by a number of different types of machines (e.g., shaker tables, gravity tables, cyclones, etc.), and with respect to several material properties or characteristics (e.g., weight, density, specific gravity, size). In this description of the preferred embodiment, specific types of mechanical separators and specific material properties will be mentioned to assist in an understanding of some forms the invention could take, but the invention is not so limited.

Because separator-cleaning means 16 has been precalibrated so that particles of predicted density will appear at each of the outlets, reliance is placed on this actually occurring. However, if separator-cleaning means is miscalibrated, or if the particular coal being cleaned has different characteristics from previous coal, adjustments may need to be made to the coal cleaning process to insure its efficiency; that is, that the desired cleaned coal is being extracted. The coal being cleaned may also react differently to the immediate conditions in the separator-cleaning means 16, than other supposedly similar coal. There are a number of reasons, therefore, why the separation process needs to be monitored.

Therefore, detector means 26, 28, 30 and 32 are placed adjacent to outlets 18, 20, 22 and 24, respectively. Each detector means allows monitoring of the particles leaving their respective outlets. The detector means impose energy or radiation (in this case, electromagnetic radiation) upon the mixture of particles, which excites the fluorescent dye attached to the control particles, if any, which are leaving that respective outlet.

If any control particles are in that part of the mixture, the excited dye will fluoresce and emit light energy which will be detected by the detector means. Therefore, information is available regarding whether the control particles are being separated appropriately.

The detector means will disclose if a sufficient number of control particles are passing through the outlet which they should predictably pass through. If this is not occurring, however, the detector means will reveal a lower intensity, whereas a detector means in another outlet from that which is predicted, will exhibit abnormally high intensity. By appropriate display or by automated means, the separation efficiency of the coal cleaning process can thus be easily monitored and controlled.

It is to be understood that it is not necessary that a detector means be placed over each outlet. One or more detector means can be utilized according to desire. For example, if it is sufficient to monitor just outlet 18 to determine the separation efficiency and operation of means 16, only one detector 26 would be needed.

Figure 2:
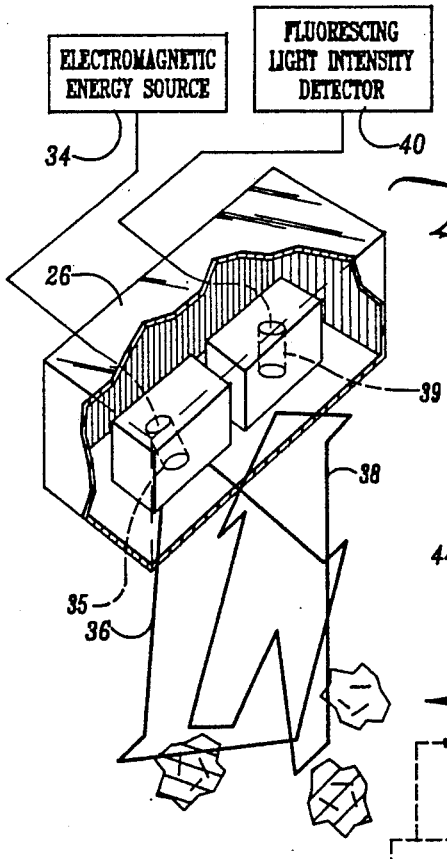
FIG. 2 is a partial cut-away view of the detector of the embodiment of FIG. 1.

FIG. 2 schematically depicts the structure of a detector means 26, 28, 30 or 32. An electromagnetic energy source 34 would be operated to impose (through an appropriate transmitter 35) electromagnetic radiation 36 upon the mixture of coal particles 12 and control particles 14. The radiation would be known to excite fluorescence in the dye bonded to the control particles. Fluorescent light or radiation 38 would then be emitted from control particles 14 and be detected by an appropriate receiver 39 connected to an appropriate fluorescing light intensity detector 40.

It is important for an understanding of the invention to note that source 34 and detector 40 are preferred to be oriented generally towards the mixture of particles by use of transmitter 35 and receiver 39. The only absolute requirement regarding their relationship to one another is that they not be placed either 180° or 360° from each other. Additionally, of course, selection of the electromagnetic source should be such that it will excite the particular fluorescing dye used on control particles 14. Additionally, the fluorescing light intensity detector must be capable of detecting emitted wavelengths from the excited fluorescing dye.

Figure 3:
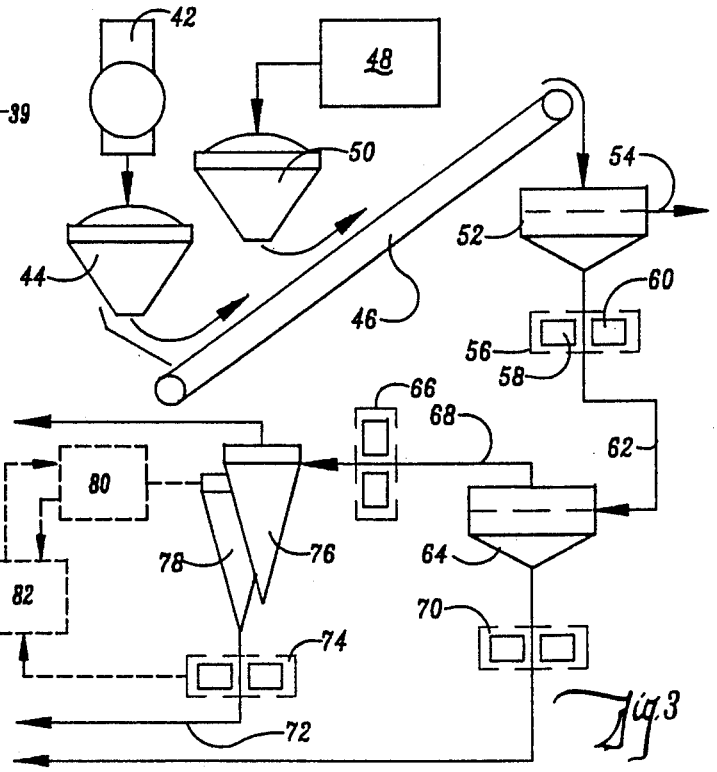
FIG. 3 is a diagrammatic view of the invention applied to a multi-function coal cleaning system.

FIG. 3, for additional understanding of the invention, shows diagrammatically a portion of a complex and combined coal cleaning and processing system. A primary crusher 42 deposits crushed coal into hopper 44, which allows a controlled outlet of crushed coal to conveyer 46. A control particle processor 48 deposits control particles in measured quantities into hopper 50. Control particles in hopper 50 are as previously described, having known physical properties (for example, generally known size and/or density) and have attached or bonded to them a fluorescing dye of known characteristics.

The crushed coal and the control particles are mixed and conveyed by conveyer 46 to various separators and cleaners in the system.

For example, a separating screen 52 can be used to separate the mixture of crushed coal and control particles from nondesired coal or refuse, which would exit via an outlet at 54. A detector means 56 could then be positioned at the outlet of separating screen 52. Detector means would include energy source 58 and intensity detector 60, which would operate as previously discussed to monitor whether sufficient control particles are exiting with the desired coal from the separating screen 52. If the intensity is sufficient, it indicates that the separation process is successfully occurring. If the intensity is insufficient, adjustments will be indicated for operation of separating screen 52.

Similarly, the coal can travel via 62 to a hydrocyclone 64. The mixture of once-separated coal and control particles would then be again separated in hydrocyclone 64. A detector means 66 similar to detector means 56 would then be placed at the outlet (se reference numeral 68 at hydrocyclone 64) to determine if the separation is proceeding correctly. A detector means 70 could also be placed at the outlet 72 of hydrocyclone 64 to detect whether control particles are being passed out an undesired path. This would then indicate nondesired and insufficient functioning of hydrocyclone 64. A detector means 74 could also be placed at the outlet of de-watering cyclones 76 and 78 for the same purpose.

It is to be understood, however, that the detector means can be positioned either on the refuse side or the clean coal side of each particular separator cleaning device or means.

It can therefore be seen that the invention has achieved a least all of its stated objectives. The control particles essentially exactly simulate how the actual coal particles travel through the separation and coal cleaning process because the control particles are coal particles. Additionally, utilizing fluorescing dye as a tracer bonded to the control particles allows the control particles to be made as minute as needed for present coal cleaning technology. The chemical bond of the fluorescing tracer dye to the coal eliminates the problems of it becoming easily dislodged, which would affect the validity of the invention.

Control particles according to the invention can be produced economically and efficiently. Furthermore, detectability of fluorescing emissions is easily achieved, with a high limit of detectability, even for very small amounts of fluorescence. In theory, it is possible to detect a single chromophore molecule if an excitation source of sufficiently graded intensity is used. In practice, it has been shown to be possible to detect chromophores at concentrations below the part per billion level.

The use of fluorescence as a tracer allows virtually instantaneous readout of fluorescent intensity. Monitoring of separation efficiency is therefore virtually contemporaneous with cleaning.

Fluorescing dyes acceptable for use with the invention impose no environmental or health hazards. Additionally, the invention will function even though a significant number of tracer particles may be obstructed by the optical density of the flowing coal stream of coal particles. Modifications can be made so that the detectors are placed in a position to monitor the coal stream at points where control particles have maximum exposure to the detector. However, inherent low detection limits of fluorescent measurements make the present invention advantageous even where low concentrations of fluorescent tracer dyes are used, or where only a small fraction of the tracers are excited.

It will be appreciated that the present invention can take many forms and embodiments. The true essence and spirit of this invention are defined in the appended claims and it is not intended that the embodiment of the invention presented herein should limit the scope thereof.

For example, fluorescence detectors are well known within the art. One example would be photo multiplier tubes. Additionally, the bonding of fluorescent dyes to coal is known in the art, such as is disclosed in U.S. Pat. No. 4,208,273 to Moudgil, which is incorporated by reference herein.

Examples of fluorescent dyes which can be used in the present invention are anionic, cationic, or neutral fluorescent dyes such as fluorescein, rhodamine, chromones, umbelliferone and their derivatives. These fluorescing dyes are commercially available from a number of chemical companies such as Aldrich Chemical of Milwaukee, Wis. or Eastman Chemical of Rochester, N.Y.

Examples of possible methods of chemically bonding these types of fluorescent dyes to coal derived particles include, but are not limited to: use of one of the vast family of carbonyl condensation reactions; Friedel-Crafts alkylation or acylation reactions; polymer grafting; and esterification, among others. Such chemical bonding procedures are well known to those in the art.

As has been previously stated, the present invention applies to all types of separation/cleaning processes and equipment for not only coal, but other materials. Examples of the separation/cleaning machines are Baum-type jigs, wateronly and/or dense-medium cyclones; concentrating tables, and other separating equipment available from such companies such as Dresser Industries, Inc. of Dallas, Tex.; Heyl and Patterson, of Pittsburgh Pa.; Krebs Engineers, Menlo Park, Calif.; and Deister Concentrator Co., Inc., Ft. Wayne, Ind.

Other enhancements are possible with the present invention. For example, more than one flourescing dye could be applied to the control particles. Alternatively, a first fluorescent dye which is excitable by a certain wavelength of electromagnetic energy could be applied to some control particles, whereas a second fluorescing dye, excited by a different electromagnetic wavelength, could be applied to other control particles. Appropriate detectors for these differing wavelengths could be utilized. It ca easily be understood that a variety of combinations of different dyes and/or different control particles could be utilized for monitoring the separation/-cleaning of coal.

For illustration only, one interesting combination would be to bond one dye to control particles of a selected density characteristic. A second dye would be bonded to control particles of a different selected size and density. By utilizing detectors for both fluorescing wavelengths, the cleaning process could be monitored to follow the separation efficiency for particles of a certain density versus particles of a certain size and density.

Another possible enhancement is schematically depicted in FIG. 3. As is well known in the art, each type of separator/cleaner device, such as the gravity tables, cyclones, shaking screens, etc. rely on some type of a control means to power its separation operation. In FIG. 3, the separator control means 80 for dewatering cyclone 78 could be connected in communication with a computer or other processing means 82. Computer 82 would in turn be communicated to receive information from detector 74. By arrangements such as this, the coal cleaning process can be semi-automatically or automatically controlled. Certain parameters could be input into computer 82. By receiving underflow or overflow detection information from detector 74, computer 82 could operate separator control means 80 to appropriately change the separation action of cyclone 78 to bring it into a desired range of operation.

Such a combination could be applied to virtually any type of separator cleaning apparatus. The separator control, such as a shaker motor on a shaking screen, could be adjusted by computer 82 interfacing and operating a servo motor or other valve to change operation of the shaker motor. It can therefore be seen that a variety of different modes of operation, can be utilized, even with complex systems, to achieve the objects of the present invention.

It is therefore to be appreciated that the present invention is not limited to cleaning of coal, but can be applied to other material processing, such as ore separation. It is to further be understood that the flourescent dyes utilized could also be multi-fluorescing in the sense that they fluoresce in response to a range or different energy wavelengths.

What is claimed is:

1. A method for improved material separation comprising:

bonding a fluorescing dye to control particles of the material, the control particles having generally known and generally consistent physical properties;

mixing the control particles into the material which is to be separated on the basis of at least one physical property;

separating the material by a physical property;

imposing upon the separated material energy of sufficient properties to excite the fluorescing dye on the control particles; and monitoring the separated material to detect the presence of and the amount of excited fluorescence to determine the amount of control particles in the separated material and to determine if the separation process is adequately separating the material.

2. The method of claim 1 wherein the method is applicable to coal cleaning processes.

3. The method of claim 2 wherein the control particles of coal are made from coal similar to that being cleaned.

4. The method of claim 3 wherein the control particles of coal are made from the coal from the same vein as the coal being cleaned.

5. The method of claim 1 wherein the method is applicable to ore separation processes.

6. The method of claim 5 wherein the control particles are of ore made from ore similar to that being separated.

7. The method of claim 1 wherein the physical property of the material can be selected from the set comprising size, weight, and density of the material.

8. The method of claim 1 wherein measured quantities of control particles are mixed with the material being separated.

9. The method of claim 1 wherein the fluorescing dye fluoresces upon the imposition of electromagnetic radiation having properties to excite fluorescence in the dye.

10. The method of claim 9 wherein the fluorescing dye has such properties so as to be excited by an energy source selected from the set comprising a xenon discharge lamp and a deuterium lamp as a source of electromagnetic radiation.

11. The method of claim 1 wherein the monitoring of the cleaned coal is accomplished by a multi-channel detector for detecting the exact wavelength of emissions from the fluorescing dye.

12. The method of claim 1 wherein the monitoring of the cleaned coal can be accomplished by a scanning detector of the wavelengths of the emitting fluorescing dye.

13. The method of claim 1 wherein the control particles can be as small as sub-micron sized particles.

14. The method of claim 13 wherein the control particles can be as small or smaller than on the order of minus 200 mesh particles.

15. A means for improved material separation comprising:

transport means for conveying material to be separated to a material separation apparatus;

injection means for mixing control particles into the material to be separated prior to entering the separation apparatus the control particles being of generally known and generally consistent physical properties, and carrying a fluorescing dye thereon; and detector means positioned at one or more output locations of the separating apparatus to monitor the output of the material separation apparatus, the detector means including a source of energy of sufficient properties to excite the fluorescing dye on the control particles, and a monitoring detector of the emitted fluorescing radiation from the excited fluorescing dye on the control particles.

16. The means of claim 15 wherein the fluorescing dye is bonded to the control particles.

17. The means of claim 15 wherein the detector means generates a signal related to intensity of detected emitted light from the fluorescing dye.

18. The means of claim 17 wherein the signal from the detector means is communicated to a control means for further use.

19. The means of claim 18 wherein the control means includes means to process the signal and can accomplish at least one of the following, display the intensity and issue instructions to adjust the separation apparatus to increase its separation efficiency.

20. The means of claim 15 wherein the fluorescing dye is taken from the set comprising anionic, cationic, and neutral fluorescing dyes.

21. The means of claim 15 wherein the source of energy for the detector means comprises electromagnetic energy.

22. The means of claim 21 wherein the electromagnetic energy source is selected from the st comprising a xenon discharge lamp and a deuterium lamp.

23. The means of claim 21 wherein the source of electromagnetic radiation and the monitoring detector have first and second aiming directions, the aiming directions being generally directed toward the mixture of material to be separated and control particles except that the aiming directions cannot be 180° or 360° in relation to one another.

24. The means of claim 15 wherein the monitoring detector detects the exact wavelengths of emissions from the excited fluorescing dye of the control particles.

25. The means of claim 15 wherien the monitoring detector is a multi-channel detector.

26. The means of claim 15 wherein the injection means includes means for mixing a measured quantity of control particles into the material being separated.

27. The means of claim 15 wherein the control particles have consistent physical properties at least one of which is taken from the set comprising weight, density, and size.

28. The means of claim 15 wherein the signal from the detector means is communicated to a processing means for further use.

29. The means of claim 28 wherein the processing means is utilized to process the signal and can accomplish at least one of the following, display the intensity and issue instructions to adjust the separation means to monitor and increase it material separation efficiency.

30. The means of claim 15 wherein the material to be separated comprises coal to be cleaned.

31. The means of claim 15 wherein the material to be separated is ore to be separated.

32. A method for improved separation of materials comprising:

pre-processing a material for preparation for separation;

preparing control particles of generally the same material as the material to be separated, the control particles being of generally known physical characteristics and predictable separation characteristics;

attaching to the control particles a fluorescent dye;

mixing the control particles with the attached fluorescent dye into the material to be separated;

separating the mixture on a continuous basis;

imposing energy of appropriate properties to excite the fluorescent dye in the control particles onto the mixture;

detecting, after separation of the mixture, at a chosen output of the separation, the intensity of emitted fluorescence from the excited fluorescent dye of the control particles;

determining from the intensity measurements whether separation is being performed efficiently; and adjusting the separation to optimize efficiency in response to the intensity measurements.

33. The method of claim 32 wherein the fluorescent dye is applied to all control particles.

34. The method of claim 33 wherein the fluorescent dye is excitable by a certain range of wavelengths of electromagnetic radiation.

35. The method of claim 32 wherein fluorescent dyes which are excitable by different properties of energy are attached to the control particles.

36. The method of claim 32 wherein a fluorescent dye excitable by a different property of energy is attached to control particles having different separation properties.

* * * * *